US011259646B2

(12) United States Patent
Blackett

(10) Patent No.: US 11,259,646 B2
(45) Date of Patent: Mar. 1, 2022

(54) SLEEP ENCLOSURE ASSEMBLY

(71) Applicant: Jacob Blackett, Indianapolis, IN (US)

(72) Inventor: Jacob Blackett, Indianapolis, IN (US)

(73) Assignee: Jacob Blackett, Indianapolis, IN (US)

( * ) Notice: Subject to any disclaimer, the term of this patent is extended or adjusted under 35 U.S.C. 154(b) by 73 days.

(21) Appl. No.: 16/222,449

(22) Filed: Dec. 17, 2018

(65) Prior Publication Data

US 2019/0183254 A1 Jun. 20, 2019

Related U.S. Application Data

(60) Provisional application No. 62/599,391, filed on Dec. 15, 2017.

(51) Int. Cl.

| | |
|---|---|
| ***A47C 29/00*** | (2006.01) |
| ***A47C 21/04*** | (2006.01) |
| ***A47C 21/00*** | (2006.01) |

(52) U.S. Cl.

CPC ..... *A47C 29/003* (2013.01); *A47C 21/003* (2013.01); *A47C 21/04* (2013.01)

(58) Field of Classification Search

CPC ..... A47C 21/003; A47C 21/024; A47C 21/04; A47C 29/00; A47C 29/003; A47C 29/006

See application file for complete search history.

(56) References Cited

U.S. PATENT DOCUMENTS

| | | | | | |
|---|---|---|---|---|---|
| 15,592 | A | * | 8/1856 | Henry | A47C 29/006 135/161 |
| 180,732 | A | * | 8/1876 | Schapker | A47C 29/006 135/147 |
| 193,745 | A | * | 7/1877 | Young | A47C 29/006 135/90 |
| 323,227 | A | * | 7/1885 | Snow | A47C 29/006 135/90 |
| 599,874 | A | * | 3/1898 | Stearns | A47C 29/006 135/125 |

(Continued)

FOREIGN PATENT DOCUMENTS

| | | | |
|---|---|---|---|
| CN | 202698480 U | | 1/2013 |
| CN | 103504864 A | * | 1/2014 |

(Continued)

*Primary Examiner* — David R Hare

(74) *Attorney, Agent, or Firm* — Winthrop & Weinstine, P.A.; Nadeem W. Schwen; Alicia Griffin Mills

(57) ABSTRACT

A multi-functional enclosed sleep environment for providing an improved sleep experience. A sleep enclosure assembly may be configured to partially or fully enclose a user's sleep area or bed. The sleep enclosure assembly may be stored within a housing located proximate to a user's bed or sleep area, and may be fully or partially deployable such that the user's bed or sleep area is fully enclosed within a canopy of the sleep enclosure assembly. The sleep enclosure assembly may include one or more environmental control modules designed to control or regulate one or more aspects of the sleep area according to a user's preferences, including the sound, light, temperature, air quality, ventilation, and/or humidity of the sleeping environment. The sleep enclosure assembly may further be controlled by software running on a computing device allowing a user to customize one or more aspects of the sleep environment.

17 Claims, 10 Drawing Sheets

(56) References Cited

U.S. PATENT DOCUMENTS 1,696,286 A * 12/1928 Smith ..... A47C 17/80 5/119
1,841,171 A * 1/1932 Clarke ..... A47C 29/006 135/90
2,105,108 A * 1/1938 Crosley, Jr. ..... F24F 1/022 62/261
2,190,867 A * 2/1940 Felciano ..... A47C 29/006 5/503.1
2,502,103 A * 3/1950 Puls ..... A47C 29/003 135/155
2,801,428 A * 8/1957 Streeter ..... A47C 21/048 5/284
3,404,684 A * 10/1968 Brewer, Jr. ..... A61G 10/04 128/204.15
4,109,331 A * 8/1978 Champeau ..... A47C 21/00 5/284
4,261,067 A * 4/1981 Rogers ..... A47C 29/003 248/240.4
4,506,511 A * 3/1985 Cameto ..... A61G 10/02 62/3.61
4,550,457 A * 11/1985 Dukkers ..... A47C 29/003 5/414
4,607,401 A * 8/1986 Sisson ..... A47C 21/00 5/280
4,644,599 A * 2/1987 Wolcott ..... A61G 7/0501 5/504.1
4,937,903 A * 7/1990 Joly ..... A47C 21/044 5/284
5,111,543 A * 5/1992 Epshetsky ..... A47C 21/00 5/1
5,303,434 A * 4/1994 Arnold ..... A47D 7/00 135/138
5,881,406 A * 3/1999 Cobb ..... A47C 21/024 5/503.1
6,360,384 B1 * 3/2002 Kuempel ..... A47C 21/08 5/414
6,425,255 B1 * 7/2002 Hoffman ..... A47C 21/044 62/261
6,588,037 B1 * 7/2003 Eno ..... A47C 29/006 135/90
6,772,458 B2 8/2004 Ellen et al.
7,150,052 B1 * 12/2006 Lawson ..... A47C 29/003 5/97
7,487,646 B2 * 2/2009 Matsushima ..... A47C 19/005 236/49.3
7,673,353 B1 * 3/2010 Khodabandeh ..... A47C 29/003 5/423
7,874,029 B2 * 1/2011 Alston ..... A47C 21/024 5/505.1
7,996,938 B1 * 8/2011 Calmes ..... A47C 21/024 5/505.1
8,074,307 B2 * 12/2011 Spratley ..... A47C 21/024 5/506.1
8,272,086 B1 * 9/2012 Calmes ..... A47C 21/024 5/505.1
8,407,835 B1 4/2013 Connor
8,991,411 B1 * 3/2015 Neuman ..... A47C 29/00 135/96
9,044,101 B2 6/2015 Garcia et al.
9,750,349 B1 9/2017 Lloyd
2014/0318586 A1 * 10/2014 Watson ..... A47C 29/003 135/90

FOREIGN PATENT DOCUMENTS

CN 103504864 A 1/2014
CN 204654351 U 9/2015
CN 105155874 A 12/2015
ES 1167259 U 10/2016
GB 2457702 A * 8/2009 ..... A61G 10/02
GB 2500938 A 10/2013
WO WO 2010/006347 A1 1/2010

* cited by examiner

200

SLEEP ENCLOSURE ASSEMBLY

CROSS-REFERENCE TO RELATED APPLICATIONS

The present disclosure claims priority to Provisional Application No. 62/599,391, entitled Sleep Enclosure Assembly, and filed Dec. 15, 2017, the content of which is hereby incorporated by reference herein in its entirety.

FIELD OF THE INVENTION

The present disclosure relates to sleep enclosure systems and, more particularly, to devices, systems, and methods for a multi-functional enclosed sleep environment for providing an improved sleep experience.

BACKGROUND OF THE INVENTION

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Sleep plays an essential role in a person's health and well-being throughout life. For example, sleep deficiency has been linked to a variety of serious chronic health problems, including increased risk of heart disease, high blood pressure, obesity, diabetes, kidney disease, and stroke. In addition to physical health, getting enough quality sleep is also important for one's emotional health. Insufficient or poor-quality sleep has been shown to negatively impact a person's happiness and quality of life, and can also contribute to depression and other mood disorders. Sleep deprivation can also impair brain function and reaction time, which can lead to performance issues at work or school, and can have more severe consequences such as causing car accidents. It is therefore important for a person to get enough quality sleep each night.

The sleeping area is central to a good night's rest. While poor-quality sleep can be linked to many different causes, there are several known environmental factors that can affect sleep quality. Important environmental factors may include, for example, noise levels, lighting, temperature, humidity, and ventilation. Depending on the person, too much or too little noise, light, temperature, air flow, and humidity may make it difficult to fall and remain asleep. While preferred sleeping environments can vary significantly from person to person, if one or more of the above environmental factors falls outside a person's preferred range, that person may suffer from poor sleep and the negative health consequences that come with it.

A variety of mechanisms have been used in an attempt to control or mitigate an undesirable sleep environment. For example, known solutions to excessive noise may include use of noise masking or cancelling technology. Similarly, excessive light has been addressed using blackout curtains or eye masks. Other devices have been developed to regulate humidity and temperature in a variety of ways using climate control and ventilation technology. But these individual measures do not provide a comprehensive solution to control the often sensitive environmental factors required for a restful sleep. Likewise, existing sleep systems and devices are not "one-size-fits-all" solutions that are effective in the widely-varying conditions of many bedrooms, and for the many different sizes and styles of beds. Moreover, other attempts to create a fully self-contained sleep environment are impractically obtrusive and ineffective at regulating the many different environmental sleep factors.

Accordingly, there is a need in the art for an enclosed, inconspicuous, mountable sleep enclosure that can effectively regulate a user's sleep environment.

BRIEF SUMMARY OF THE INVENTION

The following presents a simplified summary of one or more embodiments of the present disclosure in order to provide a basic understanding of such embodiments. This summary is not an extensive overview of all contemplated embodiments, and is intended to neither identify key nor critical elements of all embodiments, nor delineate the scope of any or all embodiments.

The present disclosure, in one or more embodiments, relates to a sleep enclosure assembly designed to partially or fully enclose a user's sleep area or bed. In some embodiments, the sleep enclosure assembly may be stored within a housing located proximate to a user's bed or sleep area, and may be fully or partially deployable such that the user's bed or sleep area is fully enclosed within a canopy of the sleep enclosure assembly. The sleep enclosure assembly of the present disclosure may also include one or more environmental control modules designed to control or regulate one or more aspects of the sleep area according to a user's preferences, including the sound, light, temperature, air quality, ventilation, and/or humidity of the sleeping environment. The disclosed sleep enclosure assembly may further be controlled by software running on a computing device allowing a user to customize one or more aspects of the sleep environment.

While multiple embodiments are disclosed, still other embodiments of the present disclosure will become apparent to those skilled in the art from the following detailed description, which shows and describes illustrative embodiments of the invention. As will be realized, the various embodiments of the present disclosure are capable of modifications in various obvious aspects, all without departing from the spirit and scope of the present disclosure. Accordingly, the drawings and detailed description are to be regarded as illustrative in nature and not restrictive.

BRIEF DESCRIPTION OF THE DRAWINGS

While the specification concludes with claims particularly pointing out and distinctly claiming the subject matter that is regarded as forming the various embodiments of the present disclosure, it is believed that the invention will be better understood from the following description taken in conjunction with the accompanying Figures, in which:

DETAILED DESCRIPTION

Figure 1A:
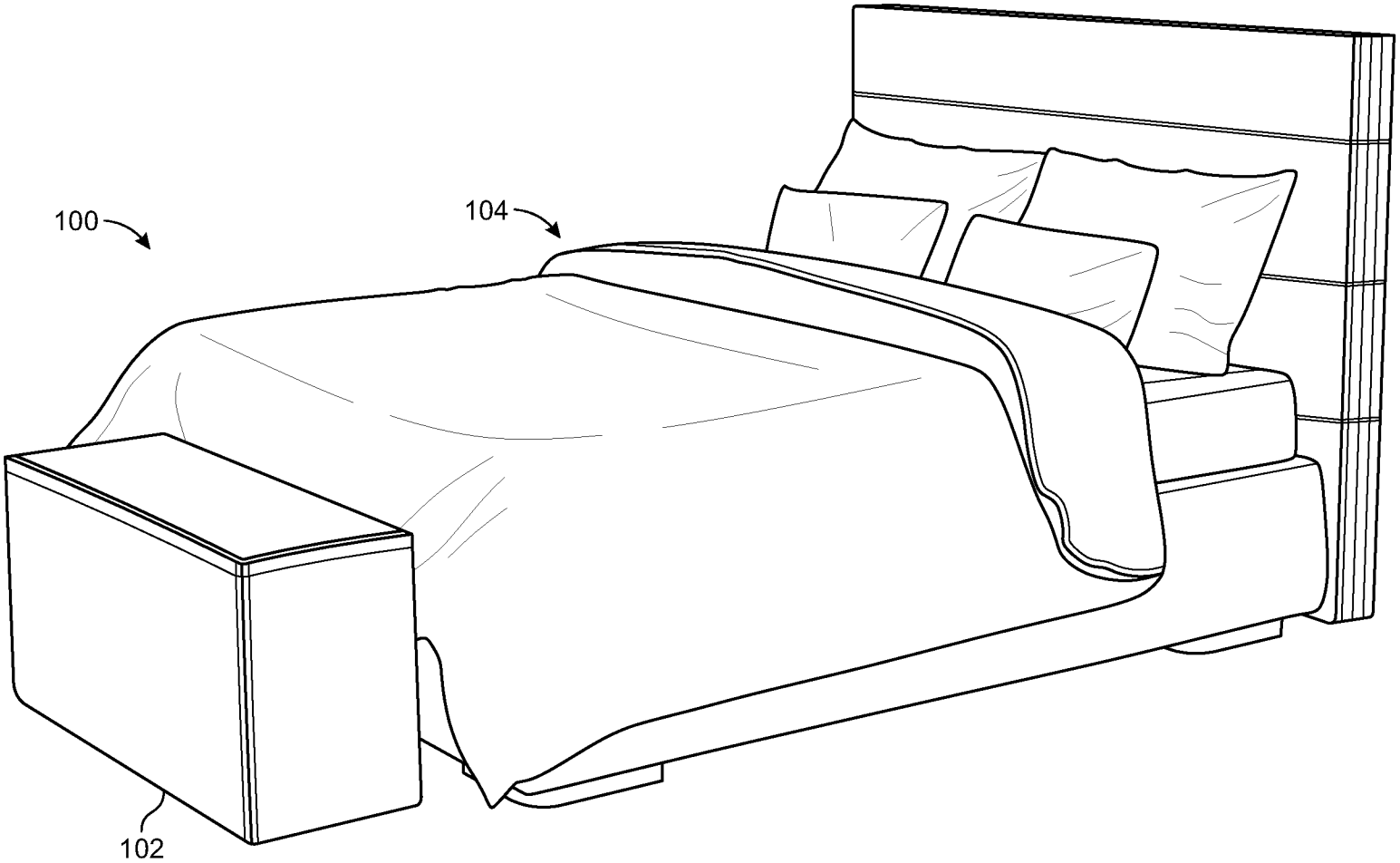
FIG. 1A is a perspective view of an embodiment of a sleep enclosure assembly of the present disclosure in a retracted position.

The present disclosure relates to one or more embodiments of novel and advantageous devices, systems, and methods for a sleep enclosure assembly for controlling a user's sleeping environment. More particularly, the present disclosure relates to a sleep enclosure assembly having a retractable canopy capable of providing a personalized sleep experience to a user. A sleep enclosure assembly of the present disclosure may be positioned proximate to a user's bed, and may include a housing containing a deployable canopy. The canopy may be operably coupled to and stored within the housing in a retracted position. The canopy may also be manually or automatically deployed into a partially or fully deployed position such that a user's sleep area is partially or fully enclosed within the sleep enclosure assembly. The sleep enclosure assembly may further have a small footprint, and may positioned in a concealed or partially concealed location proximate to the sleep area so as to be unobtrusive and improve the aesthetics of sleeping area. In some embodiments, the sleep enclosure assembly may include one or more sleep environment regulation features, including but not limited to one or more mechanisms for regulating sound, light, temperature, air quality, ventilation, and/or humidity. The sleep environment regulation features may be advantageously automated and personalized to a user's preferences. The sleep enclosure assembly may further have other advantageous features, including automation and remote control, such as by an application installed on a mobile phone or similar device.

Generally, the sleep enclosure assembly of the present disclosure in some embodiments includes a housing, canopy, extendable canopy frame, and one or more environmental control mechanisms. The housing may be removably or fixedly secured proximate to a user's bed or sleep area, including but not limited to above, below, or alongside any part of a user's bed or sleep area. The canopy may be coupled to the extendable canopy frame. The canopy and/or extendable canopy frame may be further coupled to and stored within the housing when the sleep enclosure assembly is in a retracted position. The sleep enclosure assembly may also be put into a partially or fully deployed position. When the sleep enclosure assembly is in an deployed position, the canopy and extendable canopy frame may extend through an opening in the housing such that the canopy fully or partially encloses a user's bed or sleep area. In some embodiments, the canopy may be partially deployed such that the canopy does not fully enclose the bed or sleep area, thereby allowing one or more users to enter or leave the sleep area. In some embodiments, the sleep enclosure assembly may further include one or more environmental regulation features fixed within the canopy, housing, and/or sleep area, including but not limited to one or more lighting modules, audio modules, climate control and ventilation modules, and/or diffusion modules.

Figure 1B:
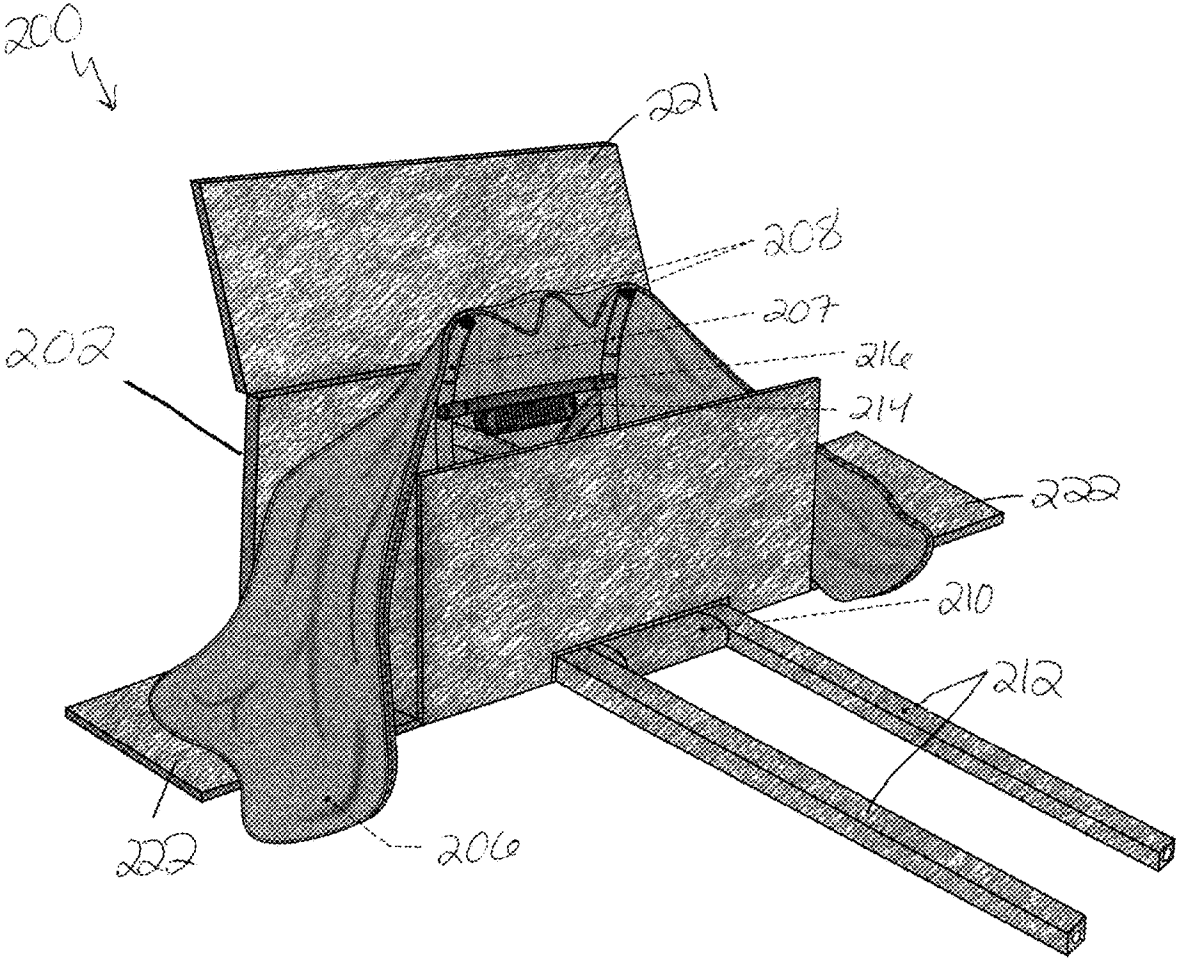
FIG. 1B is a perspective view of another embodiment of a sleep enclosure assembly of the present disclosure a partially deployed position.

FIG. 1A is a perspective view of an embodiment of a sleep control assembly 100 according to the present disclosure shown in a retracted position. In some embodiments, all elements of the sleep enclosure assembly may be fully contained within housing 102 located at the foot of the bed 104 or sleeping area. As shown in FIG. 1A, in some embodiments, housing 102 may comprise an ottoman or similar box-like structure designed to visually blend in with the bedroom area and remain inconspicuous when in a retracted position. In some embodiments, housing 102 may have a closed position when the sleep enclosure assembly 100 is in a retracted position, and an open position when the sleep enclosure assembly is in a deployed position. FIG. 1A shows an embodiment showing the housing 102 in a closed position, with the remaining elements of the sleep enclosure assembly 100 contained within housing. FIG. 1B shows an embodiment of housing 102 in an open position, as further discussed below.

According to some embodiments, the housing 102 may be composed of wood with steel fasteners and a steel frame. The housing 102 may further include one of several finish options, including but not limited to stained wood, painted wood, vinyl adhesive, upholstered fabric, or upholstered leather. In other embodiments, housing 102 may be composed of one or more materials, including but not limited to woods, metals, plastics, rubbers, ceramics, or other materials with similar properties known to a person of skill in the art. While housing 102 is shown to have a box-type design in FIG. 1A, the housing may be cylindrical, round, or any other suitable shape or size necessary to contain and secure the components of the sleep control assembly of the present disclosure. The housing 102 may further include a power cable for plugging the unit into a standard power outlet in order to supply electricity to each of the components within the housing, including motors, environmental control modules, and the like.

FIG. 1B is a perspective view of a sleep enclosure assembly 200 according to the present disclosure in a partially deployed position. Housing 202, shown in an open position, may contain several components of the sleep enclosure assembly 200, including a canopy 206, an extendable canopy frame 207, which may include one or more canopy poles 208, a track motor 210, and a track 212. In some embodiments, sleep control assembly housing 202 may be configured to open from a closed position in order to allow the components of the sleep enclosure assembly 200, including canopy 206 and extendable canopy frame 207, to extend over a user's bed 204 or sleep area. As shown in the illustrated embodiment in FIG. 1B, the interior of housing 202 may be accessed through a lid 221 and/or side-doors 222 in the housing. The lid 221 and side doors 222 may open using a hinge mechanism, or may open through another mechanical operation, such as sliding or other similar movement. In some embodiments, the hinged lid 221 and side doors 222 may be opened manually by a user, or may be pushed open through automatic movement of the canopy 206 and/or canopy frame 207. Alternatively, the hinged lid 221 and side doors 222 may have independent motorized movement, and may open independently from the movement of the canopy 206 and extendable canopy frame 207. In some embodiments, once the housing lid 221 and side-doors 222 are opened or removed, extendable canopy frame 207, which may be coupled to canopy 206, may be deployed through the openings in the housing 202.

Canopy 206 may be composed of one or more materials capable of partially or completely blocking out environmental light in order to create darkness within the sleep area, including but not limited to one or more fabrics, plastics, and/or other similar suitable material. In some embodiments canopy 206 material may be lightweight and breathable for optimal ventilation within the sleep area, and for ease of storage of the canopy within the housing 202 when retracted. In one embodiment according to the present disclosure, canopy 206 may be composed of Roc-Ion® Blackout Lining or similar suitable material.

In some embodiments according to the present disclosure, canopy 206 may be operably coupled to extendable canopy frame 207 such that upon deployment of extendable canopy frame, canopy may extend from housing 202 together with canopy frame. Canopy 206 may further be coupled to extendable canopy frame 207 such that when the sleep enclosure assembly 20 of the present disclosure is in a partially or fully deployed position, tension is maintained across canopy, and drooping or sagging of the canopy material into the sleep area is avoided. Extendible Extendable canopy frame 207 may be composed of one or more materials capable of supporting canopy 206, including fiberglass, graphite composite, plastic, carbon fiber, metal, or other suitable material.

In one embodiment according to the present disclosure, extendable canopy frame 207 may include two or more extendable canopy poles 208 designed to extend from housing 202 into a partially or fully deployed position as shown below with respect to FIGS. 2B and 2C. In one embodiment according to the present disclosure, canopy 206 may be coupled to canopy poles 208 of extendable canopy frame 207 using a clip and/or elastic strap securing the top of the canopy poles to the canopy. The canopy 206 may further be secured to the interior of the housing 202 using one or more fastening mechanisms, such as using Velcro, adhesives, buttons, ties, male-and-female style fasteners, or similar fastening mechanisms. Accordingly, in some embodiments, when the canopy poles 208 of extendable canopy frame 207 extend from housing 202 into a deployed position, canopy 206 may be drawn tightly across the canopy poles due to the tension created between the canopy poles. Canopy 206 may further include one or more sleeves through which the canopy poles 208 of extendable canopy frame 207 may extend in order to provide tension across the material between the canopy poles, and prevent sagging. In one embodiments, the one or more sleeves may be attached to the canopy 206 material such that to facilitate retraction of the canopy into the housing 202. For example, in some embodiments, the canopy sleeve may be sewn to the topside or bottom side of the canopy 206 material. The sleeves within canopy 206 may further be elastic such that canopy poles 208 provide tension by stretching the material between the poles. In some embodiments, the canopy poles 208 of extendable canopy frame 207 may further jut in different directions in order to increase tension across the canopy 206 material, and to maximize the sleep area. One embodiment of this arrangement is further shown below with respect to FIGS. 3A and 3B.

In one or more embodiments, when in a retracted position, canopy poles 208 of extendable canopy frame 207 may be configured to be slidably received within tracks 212 located beneath a user's bed 204 or sleeping area as shown in FIG. 1B. In some embodiments, tracks 212 may be coupled directly to housing 202, and positioned in an inconspicuous position, such as underneath the user's bed 204 or sleeping area. Tracks 212 may be composed of one or more materials sufficient to receive and support extendable canopy frame 207, including but not limited to one or more metals, plastics, woods, or other suitable material. In other embodiments the canopy poles 208 may have a collapsible or telescoping design for minimizing necessary storage space within housing 202 when in the retracted position.

The canopy poles 208 of extendable canopy frame 207 may be manually deployed and retracted by a user within tracks 212, or may be automatically deployed and retracted, such as by use of a track motor 210. In some embodiments, track motor 210 may be secured on or within housing 202 using a suitable fastener such as screws, bolts, adhesives, Velcro, male-and-female style fasteners, or similar fastening mechanisms. In other embodiments, track motor 210 may be a separate component operably coupled directly to the canopy poles 208. According to some embodiments of the present disclosure, track motor 210 may include an electric motor, such as a motorized belt drive designed to deploy and retract the canopy poles 208 from and into the housing 202 and tracks 212, respectively. In some embodiments, the canopy poles 208 of extendable canopy frame 207 may be coupled directly to tracks 212, while in other embodiments canopy frame may interface with tracks through an intermediary mechanical component.

In operation, track motor 210 may engage with the canopy poles 208 stored within tracks 212, and push the canopy poles of extendable canopy frame 207 and canopy 206 out of openings in housing 202 into a deployed position as shown below with respect to FIGS. 2B and 2C. Similarly, in order to retract canopy frame 207 within tracks 212, track motor 210 may engage with the canopy poles 208 and push them in the opposite direction back into tracks. As discussed above, as extendable canopy frame 207 deploys from housing 202, the canopy poles 208 and canopy 206 may engage the hinged openings of housing 202, thereby pushing open the lid 221 and/or side-doors 222 of housing (h) during deployment. Alternatively, in another embodiment, the lid 221 and side-doors 222 of housing 202 may have mechanical releases or motors causing the lid and side-doors to open automatically during deployment.

Figure 2A:
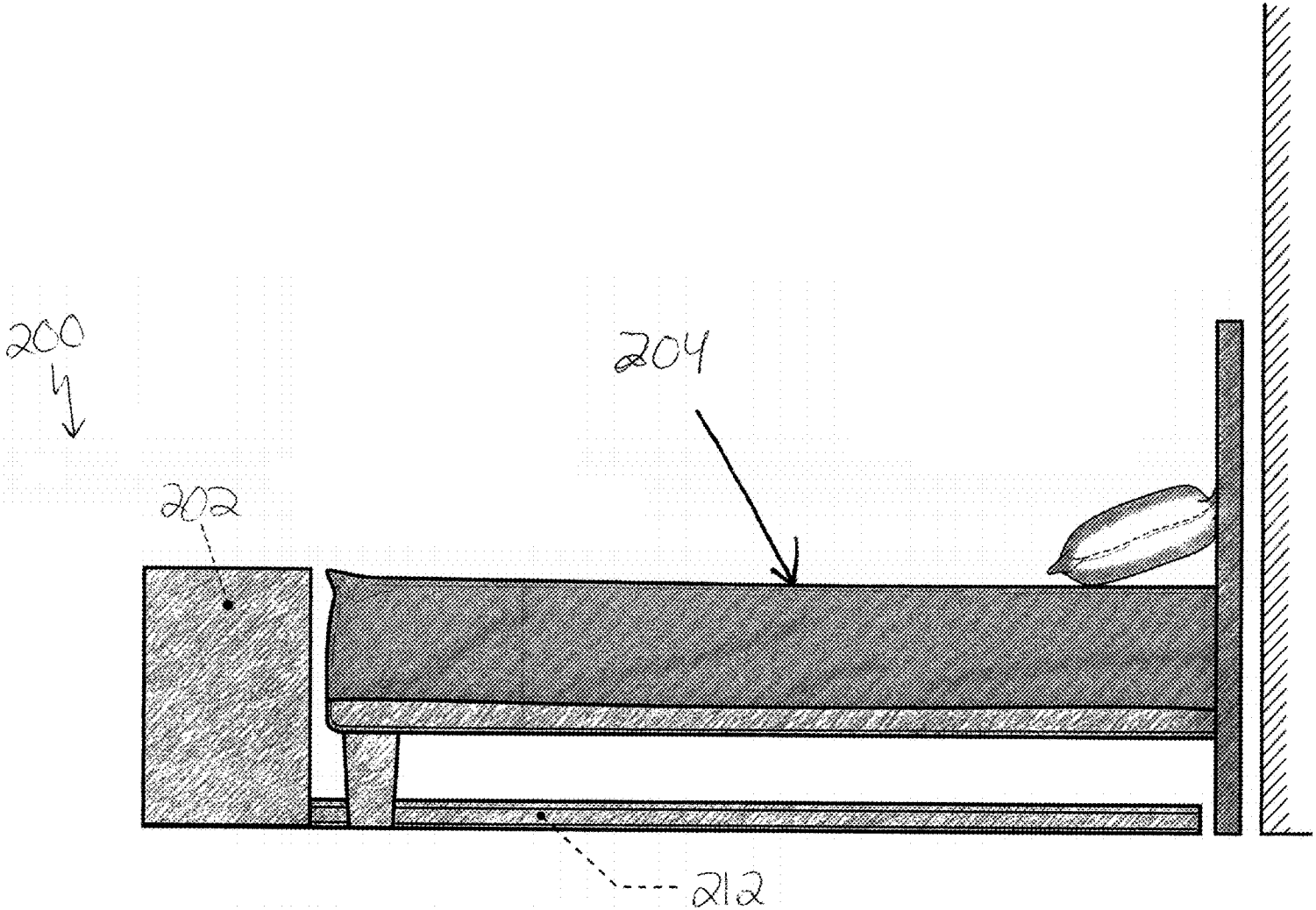
FIG. 2A is a side view of another embodiment of a sleep enclosure assembly of the present disclosure in a retracted position.

FIG. 2A shows a side view of an embodiment of a sleep enclosure assembly 200 of the present disclosure in a retracted position. As shown, housing 202 is positioned at the foot of the bed 204, and is in the closed position, with lid 221 and side-doors 222 closed. In the illustrated embodiment, motorized tracks 212 containing canopy poles 208 are positioned inconspicuously underneath the bed 204. As discussed in the present disclosure, housing 202 may be positioned in one or more advantageous positions such that the canopy 206 may be deployed to enclose a user's bed 204 or sleep area.

Figure 2B:
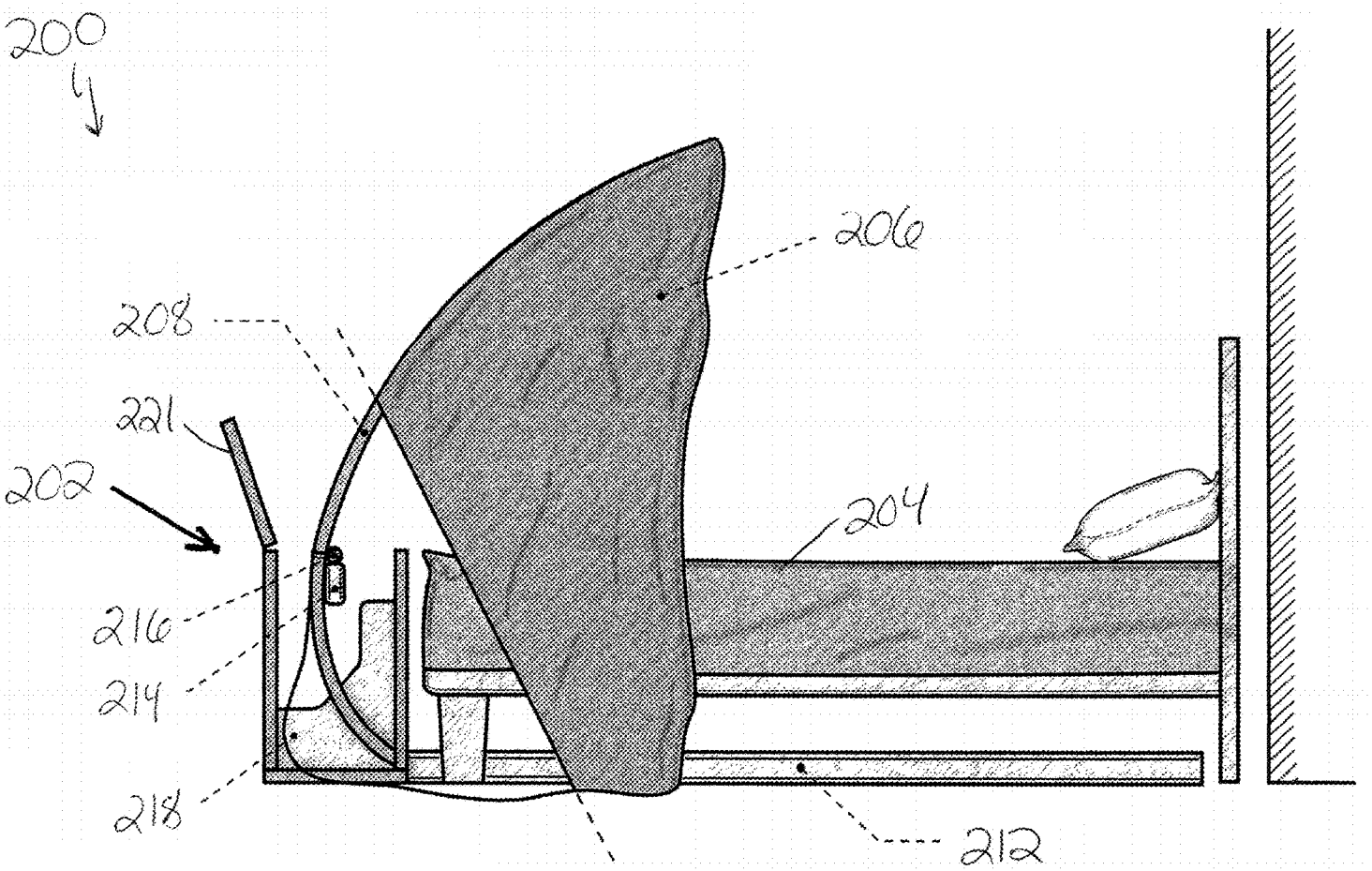
FIG. 2B is a side view of another embodiment of a sleep enclosure assembly of the present disclosure in a partially deployed.

FIG. 2B illustrates a side view of an embodiment of a sleep enclosure assembly 200 of the present disclosure in a partially deployed position. In the partially deployed position, a user may easily enter and leave the sleep area from the side of the bed 204. While the illustrated embodiment is shown in a substantially halfway open position, the sleep enclosure assembly 200 may be put in one or more other partially open positions such that the enclosure may be less, or more enclosed than the embodiment shown, without being completely deployed or retracted. As shown, the hinged lid 221 and side-doors 222 of housing 202 are in the open position, and canopy poles 208 supporting the canopy material 206 may be partially extended from the open housing. The canopy material 206 may further drape over the sides of the canopy poles 208, and may further fall along the sides of the bed 204 to partially enclose the sleeping area. The canopy material 206 may include weights to keep the canopy sides in place, and to prevent excessive movement or swaying of the canopy material. In some embodiments, weights may be sewn into the edges of the draped canopy material 206, including, for example, metals, ceramics, or other heavy material.

In the embodiment pictured in FIG. 2B, canopy 206 is shown in partial cut-away to illustrate the interior of housing 202. Housing 202 may include one or more environmental control modules, including but not limited to one or more modules designed to control and/or regulate sound, light, temperature, air quality, ventilation, and/or humidity within the sleep area of the sleep enclosure assembly. The environmental control modules may be secured within housing 202, or they may be located in any other suitable position, including but not limited to on the exterior of housing, on canopy 206, or on any part of the bed 204 within the sleeping area. The modules may further be mounted using one or more fasteners such as screws, bolts, adhesives, brackets, Velcro, male-and-female style fasteners, or similar fastening mechanisms. The environmental control modules may be electrically controlled or manually controlled by the user. In some embodiments, the environmental control modules may be networked into a common control system, such as over a Wi-Fi, radio, infrared, or Bluetooth network that is communicatively coupled to a computing device, such as mobile device or computer. In other embodiments, the environmental control modules may be independently controlled, and may use one or more different communication protocols.

In some embodiments, a software application executing on the computing device may be communicatively coupled to the environmental control modules, thereby allowing a user to control and personalize the various environmental control modules according to preference using a single computing device. Alternatively, the sleep enclosure assembly may include an integrated control panel computing device for use by a user. The control panel may be located in one or more positions in, on, or around the sleep enclosure system. As with the environmental control modules, the computing device may also control any feature of the sleep enclosure system, including the retraction and deployment the canopy, as well as the opening and closing of the housing. In another embodiment, the control panel may be projected onto the interior of the canopy, such that a user may view the display screen while lying down or sitting up within the sleep enclosure assembly. The control panel may further comprise a fully functional media system, and may be integrated with audio devices within the sleep area, thereby allowing a user to view videos, pictures, television programs, video games, or any other media.

The sound environmental control module may comprise an audio speaker 214 secured in or on the housing 202, canopy frame 207, bed 204, or in another location providing for good acoustics to a user within the sleep enclosure assembly 200. In some embodiments, the audio speaker 214 may be networked with and controlled by the computing device discussed above. In one embodiment according to the present disclosure, the speaker 214 may be communicatively coupled directly to one or more computing devices in order to allow a user to play desired audio over the speaker. For example, a user may have a mobile phone computing device communicatively linked to speaker 214 over a Bluetooth network, thereby allowing the user to play music, soothing sleep sounds, white noise, nature sounds, recorded audio, motivational scripts, news alerts, or other preferred audio direction from his or her mobile phone or another device. In some embodiments, the sound environmental control may further include noise cancelling technology to block out environmental noise pollution.

The lighting environmental control module may comprise one or more light sources 216 secured in or on the housing 202, canopy frame 207, bed 204, or in another location providing for good lighting conditions for a user located within the sleep enclosure assembly 200. In some embodiments, the lighting module may be positioned at the foot of the bed 204. In other embodiments, the lighting module may be positioned at the top of the canopy 206, or top of the bed 204, so as to illuminate the sleep enclosure when the light is activated. The lighting module may further include traditional bulb technology, LEDs, energy efficient lighting, or other composite lighting technology. In one embodiment according to the present disclosure, the lighting environmental control module may comprise a light bar 216, such as a long and/or narrow light. As with the other environmental control modules, the lighting module may be networked with and controlled by a computing device as discussed above, or manually controlled by a user. In some embodiments, the lighting module may also have customizable features, such as the ability to adjust brightness and/or color temperature.

The lighting module may have one or more settings accessible from the application running on the computing device, including settings for sunrise, sunset, daytime, reading, a night light, and a custom setting. Each of the settings may include an associated brightness and color temperature setting. In one embodiment according to the present disclosure, the brightness setting for the lighting module may range from 0% brightness up until 100% brightness. In one embodiment, the light may increase brightness in 10% increments up to 100%, as shown in Table 1 below. In some embodiments, the color temperature setting may range from 1,500 Kelvin (K) to 5,500 K, and may increase or decrease in increments of 500 K. In some embodiment, other increments may be selected by a user in order to fine-tune brightness and color temperature settings. According to some embodiments, the 10% to 40% brightness range and 1,500 K to 3,000 K color temperature range may correspond to the sunrise and sunset settings. Likewise, the daytime settings may range from 50% to 100% brightness, and corresponding color temperatures of 3,500 K to 5,500 K. The night light setting may also correspond to 10% brightness with a color temperature of 1,500 K, while the reading setting may correspond to a greater brightness necessary for reading, such as 70% brightness with a color temperature of 4,500 K. In other embodiments, a user may select a custom setting with any combination of brightness and temperature settings available from the lighting module.

TABLE 1

| | Brightness | Temperature |
|---|---|---|
| Sunrise/Sunset Range | 10% | 1,500 K |
| | 20% | 2,000 K |
| | 30% | 2,500 K |
| | 40% | 3,000 K |
| Daytime Range | 50% | 3,500 K |
| | 60% | 4,000 K |
| | 70% | 4,500 K |
| | 80% | 5,000 K |

TABLE 1-continued

| Brightness | Temperature |
|---|---|
| 90% | 5,500 K |
| 100% | 5,500 K |

In some embodiments of the present invention, a user may select from a list of preprogrammed, or custom user-created routines. For example, a user may select a wake-up routine or sunrise routine using the software running on the computing device which may command the lighting module brightness to increase from 0% to 70% brightness, with a corresponding increase in color temperature from 1,500 K to 3,000 K over a period of time as preprogrammed in the software, or as custom selected by a user. Alternatively, a selection of the go-to-sleep setting may reverse the routine until the lighting module is dark.

The air/climate control environmental control module may comprise one or more heating, ventilation, and air conditioning (HVAC), air purification, medical, or aromatherapy elements. The air/climate control module may be secured in or on the housing 202, canopy frame 207, bed 204, or in another location providing for good circulation for a user within the sleep enclosure assembly 200. For example, as shown in FIG. 2B, the air/climate control module 218 may be contained within housing 202. In some embodiments, the air/climate control module 218 may be networked with and controlled by the computing device discussed above. In some embodiments, the air/climate control module 218 may include an air cooling and heating functionality. When the canopy 206 is in the fully deployed position, air may be drawn from within the canopy using a motorized fan or similar device, and passed through an air filter, through a cooling or heating element, and then returned back into the canopy. The cooling element may include use a refrigerant and condenser system used to cool air within the sleep enclosure. In some embodiments, condensation created during the air conditioning process may be stored within a reservoir, and the water level monitored by a sensor networked to the computing device by a water level sensor. When the reservoir is full, the user may be alerted via the control software so that the excess water may be drained by the user. In one embodiment, the air cooling unit may also automatically shut off when the water reservoir is full to avoid water damage. In other embodiments, the water reservoir may be emptied automatically into a nearby drain, for example, using a water pump and hose system.

The heating element may include heated metal coils, or other known heating techniques. The air filter element may further be configured to cleanse and filter the air within the sleep enclosure and provide for a healthier sleeping environment. Moreover, a humidifier may be included in the air/climate control module in order to provide users with the ability to add or remove humidity to and from the climate, which may be beneficial for certain user health conditions, such as asthma. Some embodiments of the present invention may also provide for integration of one or more medical devices, such as continuous positive airway pressure (CPAP) devices used to treat sleep apnea, oxygen sources for conditions requiring supplemental oxygen, and any other medical device for use during sleep. Finally the air/climate control module may include a diffuser element for dispensing concentrated aromatherapy throughout the sleep enclosure assembly. In some embodiments, the canopy (e) may include one or more vents to allow air within the enclosure to circulate. The one or more vents may be located, for example, at the top of the canopy, or any other preferred location. As discussed above, circulation may also be facilitated by the use of a breathable canopy material. In some embodiments, a circulation device may be used to force warm or cool air beneath a user's bedsheets, depending on a user's preferences.

Each of the heat, cooling, diffuser, humidifier, medical, and filtration elements within the air/climate control module may be controlled and customized by a user through software running on the computing device. For example, a user may set preferred temperatures for going to sleep and waking up, or higher or lower fan speeds depending on the amount of desired circulation. The fan may further be configured to contribute white noise to the sleep enclosure, and aid a user in falling or remaining asleep by masking environmental noise pollution. The computing device may further allow the air/climate control module to be integrated with any preprogramed or user-generated routines, such as wake-up and go-to-sleep routines, as supported by the control software. For example, the computing device software may cause the heating element to introduce warm air as part of the go-to-sleep routine to simulate a sun setting over a period of time. Routines may further be customized to begin or end at certain times according to depending on the time. The sleep enclosure assembly may further be programmed to conduct other routines utilizing one or more environmental control modules, such as guided meditation providing particular temperatures, ventilation, aromatherapies, and music or other audio according to the user's preferences.

In other embodiments, the sleep enclosure assembly may include one or more sleep sensors used to detect a user's circadian rhythm. Such sleep sensors may be used to monitor and record a user's sleep patterns, and may be integrated with software applications. Sleep sensors may comprise motion, movement, or vibration sensors. In some embodiments, a user may configure the sleep enclosure assembly software to begin a wake-up cycle routine during a particular time during a user's sleep cycle.

Figure 2C:
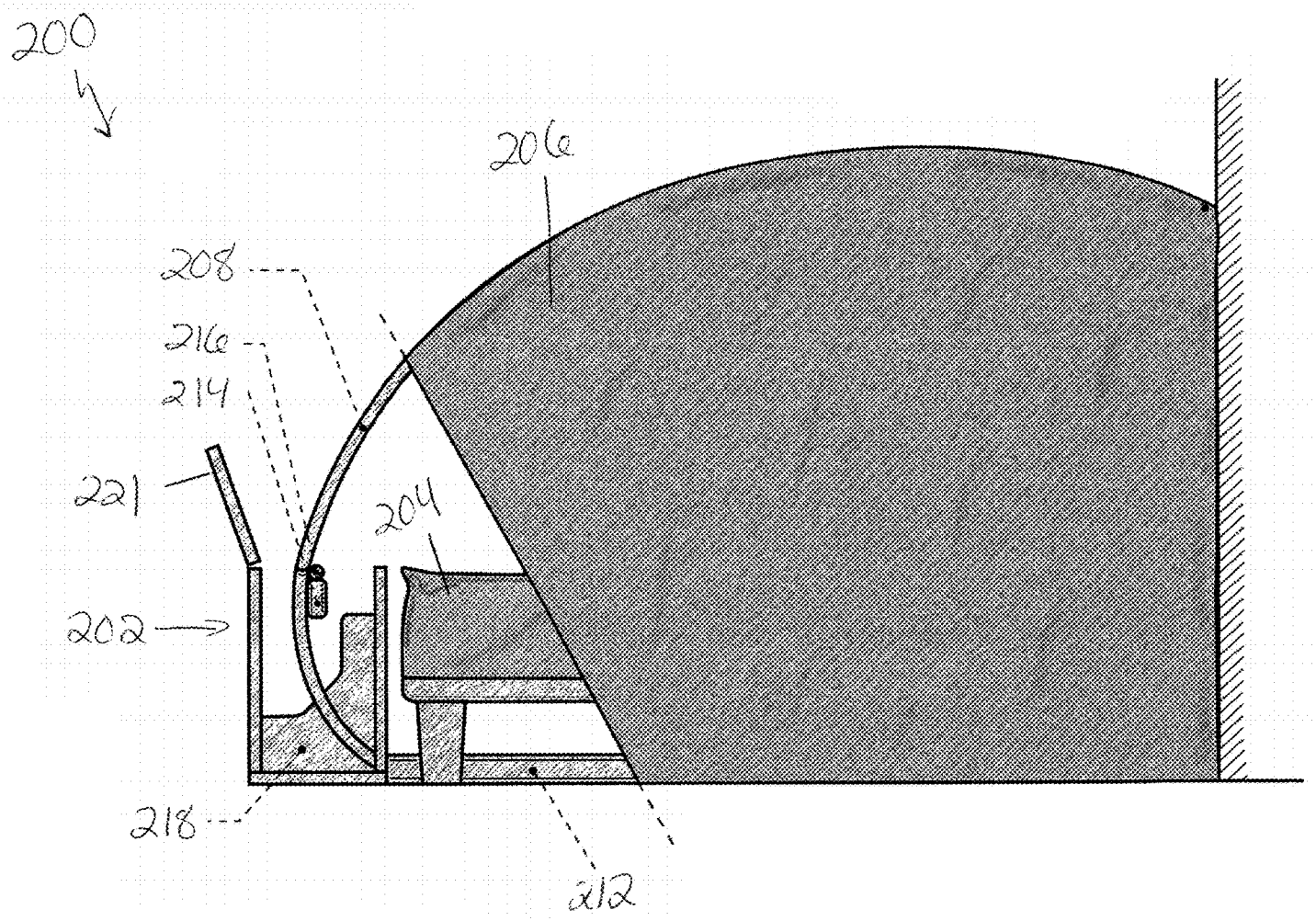
FIG. 2C is a side view of another embodiment of a sleep enclosure assembly of the present disclosure in a fully deployed position.

FIG. 2C illustrates a side view of an embodiment of a sleep enclosure assembly 200 of the present disclosure in a fully deployed position. In the fully deployed position, a user may in some embodiments enter or leave the sleep area by manually pushing aside the draped canopy material 206. In other embodiments, the sides of the canopy 206 may include other ingress or egress options, such as a zipped or buttoned opening panel. As shown, the hinged lid 221 and side-doors 222 of housing 202 are in the open position, and canopy poles 208 supporting the canopy material 206 may be fully extended from the open housing as pushed by motorized track 212. As shown in FIG. 2C, canopy poles 208 may fully extend such that the ends of canopy poles may abut the wall behind the sleeping area or bed 204 to substantially enclose the sleep area for a user. In some embodiments, canopy poles 208 may have a curved or arched configuration when in the deployed position, as shown in FIG. 2C, while in other embodiments, canopy poles may extend in a flatter or linear manner. Canopy poles 208 may further extend such that the canopy frame 207 and canopy material 206 provide more or less headspace for a user while the sleep enclosure assembly 200 is in the deployed position, depending on the preferences of the user.

The ends of canopy poles 208 may include end caps for the avoidance of any damage to the poles or bedroom wall. Canopy pole end caps may be composed of soft materials such as rubber, certain plastics, or other suitable material. In other embodiments, canopy poles 208 may extend in the deployed position to abut the headboard of a bed 204, or another physical structure behind the bed other than a wall. In other embodiments, canopy poles 208 may engage with the one or more retention mechanisms located on one or more features located on the wall or headboard behind the bed 204. For example, canopy poles 208 may removably attach using a male-female fastening device in order to secure the canopy to the wall or headboard such that the sleep enclosure may be securely enclosed. Other removable fastening mechanisms may further be employed as known by those skilled in the art.

In some embodiments, the interior of the deployed sleep enclosure assembly 200 may include one or more pockets or storage areas for the convenience of the user within the sleep enclosure. Pockets may be sewn into the canopy material 206, in some embodiments, or may be integrated from an external container through other means, such as through adhesives or another fastening device. In some embodiments, canopy pockets may further include a tag to instruct a user to empty pockets before setting the canopy 206 into the retracted position. In other embodiments, canopy pockets may be able to retain certain objects when the sleep enclosure assembly 200 is returned to the retracted position without interfering with the mechanical operation of the sleep enclosure assembly.

Figure 3A:
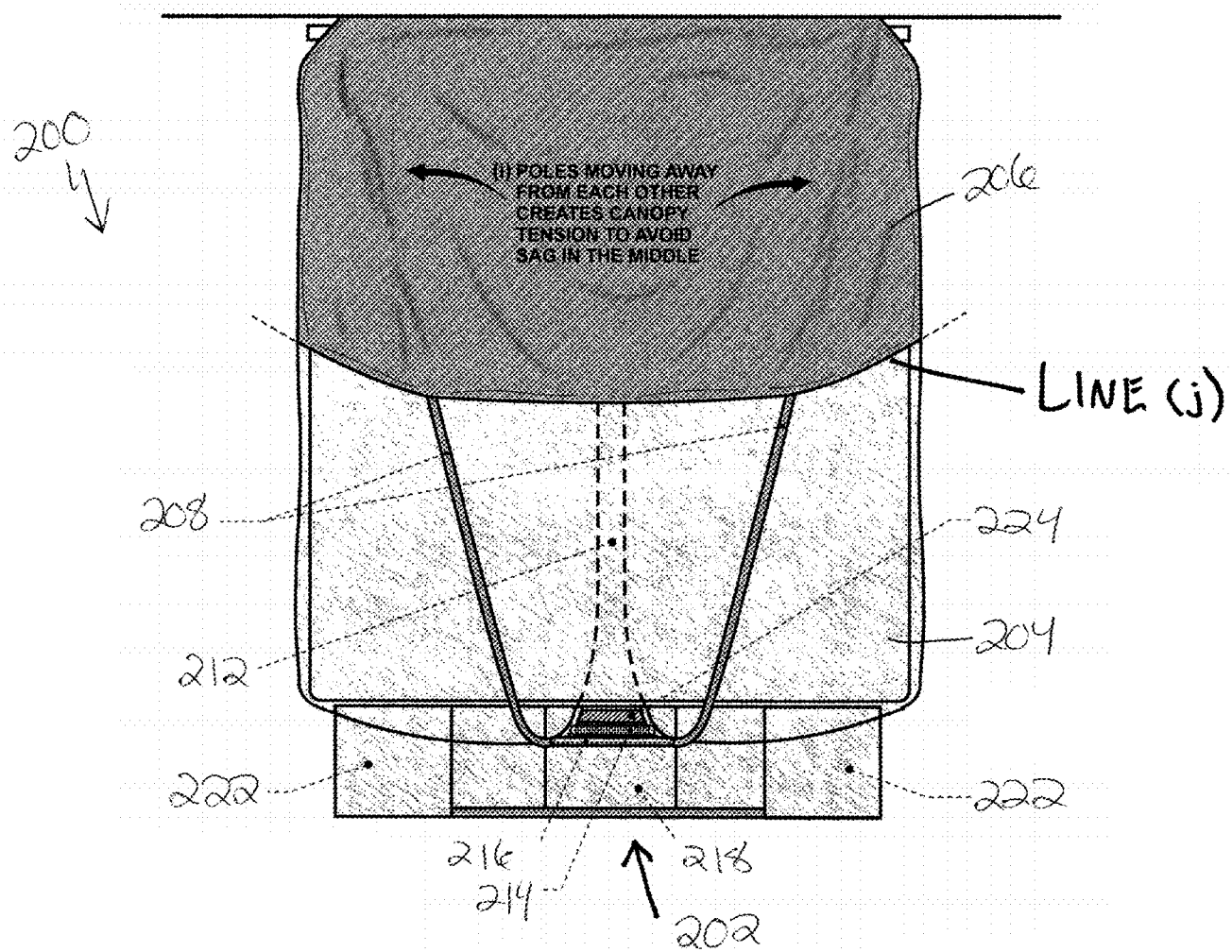
FIG. 3A is a top view of another embodiment of a sleep enclosure assembly of the present disclosure in a fully deployed position.
Figure 3B:
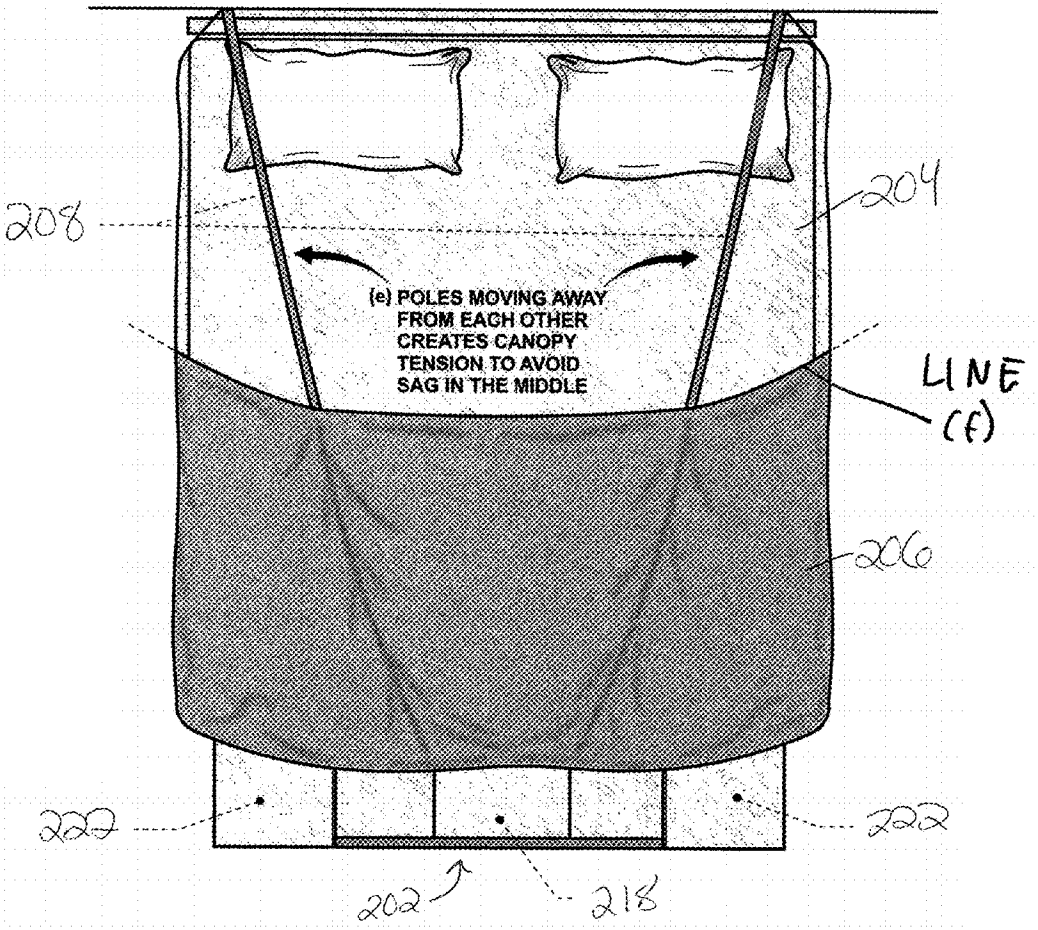
FIG. 3B is a top view of another embodiment of a sleep enclosure assembly of the present disclosure in a fully deployed position.

FIG. 3A illustrates a top view of an embodiment of the present disclosure in the fully deployed position. FIG. 3A is shown with the canopy material 206 in partial cutaway along line (j). As shown in one embodiment, poles 208 may jut in opposite directions from housing 202 in the open position. This configuration may allow for sustained tension across the canopy material 206, and may prevent sagging. The illustrated jutting configuration may further provide for a greater area within the sleep enclosure assembly 200 in the deployed position, allowing a user more head clearance, as well as for avoidance of any feelings of claustrophobia. As discussed above, however, other arrangements are contemplated for poles 208 according to the present disclosure, including configurations with more or less distance between the fully deployed poles, configures with more or less support poles in the canopy frame, or other support structures capable of supporting the canopy material over the sleep area or bed 204. Also visible due to the canopy cut-away along line (j) in FIG. 3A is light bar 216, audio speaker 214, and air/climate control module 218 secured within open housing 202. Air/climate control module 218 further includes an air duct 224 for circulation, although as discussed above, ducts and vents such as duct may be located in any advantageous position capable of providing sufficient air circulation for a user. FIG. 3A further demonstrates an embodiment of housing 202 with opened box sides 222. One embodiment of motorized track 212 is further shown below the pictured bed 204 in dashed lines. FIG. 3B illustrates a top view of an embodiment of the present disclosure in the fully deployed position with canopy material 206 in partial cutaway along line (f). As shown in one embodiment, poles 208 may abut the wall or headboard area behind the bed 204 or sleeping area in order to fully enclose the sleeping area.

Figure 4B:
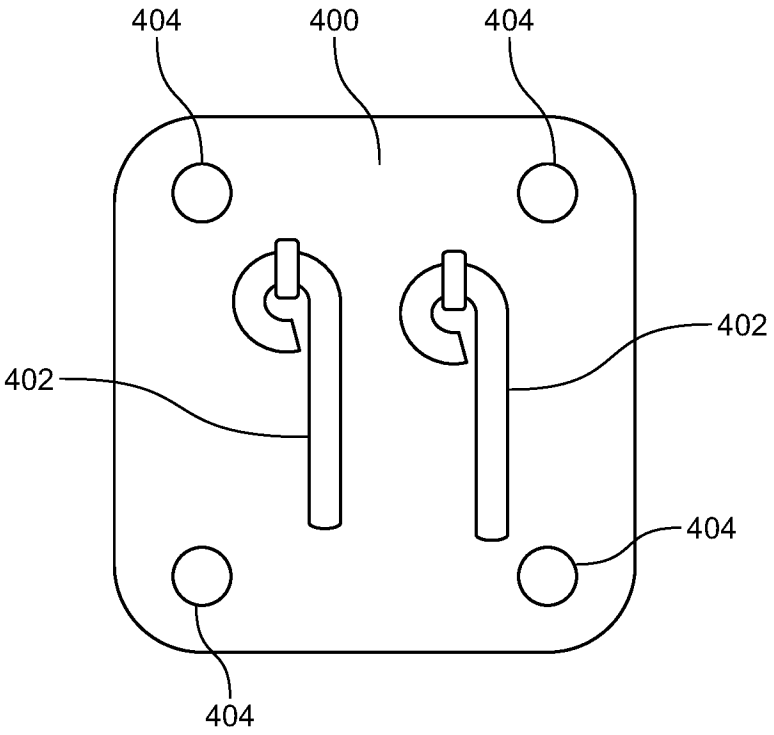
FIG. 4B is a front view of another attachment plate of a sleep enclosure assembly of the present disclosure.
Figure 4A:
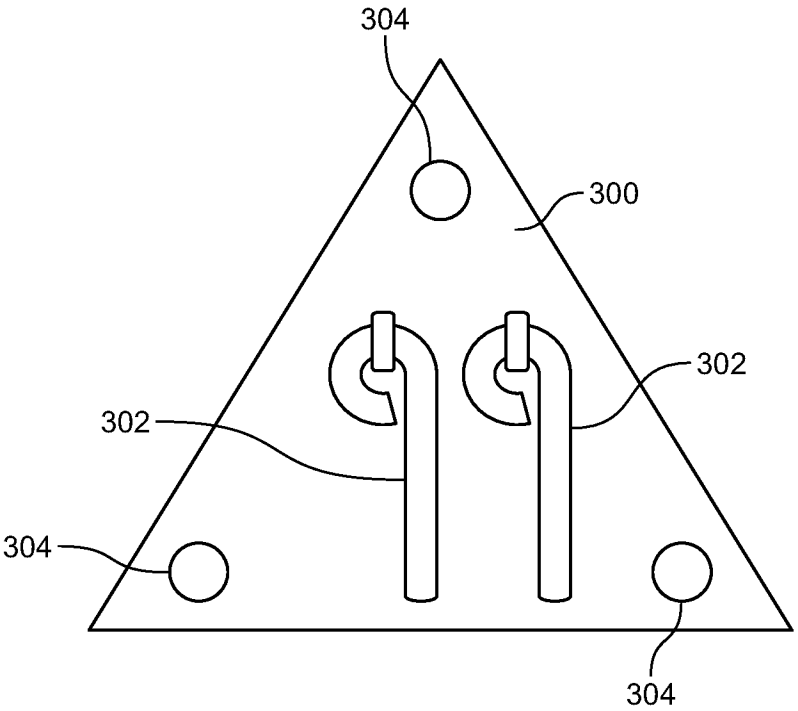
FIG. 4A is a front view of an attachment plate of a sleep enclosure assembly of the present disclosure.

In some embodiments, a pole or other frame element may be configured to couple to a wall, headboard, or other surface. For example, one or more poles of a canopy frame may couple to a wall surface or other surface using pins, screws, bolts, clips, and/or any other suitable attachment mechanism. FIG. 4A shows one embodiment of an attachment plate 300 according to one or more embodiments. As shown, the attachment plate 300 may have arranged thereon one or more pins 302 configured to couple to one or more poles of a canopy frame. For example, each pin 302 may extend from the plate 300 and may be configured to be received in an opening of a frame pole. The pins 302, or other attachment mechanism(s), may be configured to be removably coupled to the pole(s), such that a user may couple and decouple the poles from the mounting plate 300 as desired. In other embodiments, additional or alternative attachment mechanism(s) may be arranged on the plate 300. For example, in some embodiments, in addition to the pin(s) 302, the plate 300 may have a hook-and-loop portion configured to couple to the canopy material.

The attachment plate 300 may be mounted to a wall, headboard, or other suitable surface using one or more screws 304, bolts, or other suitable mounting mechanisms. In some embodiments, the attachment plate 300 may be mounted to a wall or other surface using a removable or temporary mounting mechanism. The attachment plate 300 may have any suitable size and shape configured to provide the pin(s) 302 and/or other attachment mechanism(s). In some embodiments, the plate 300 may be configured to be relatively small so as to be discreetly mounted on a bedroom wall or headboard, for example. In some embodiments, the mounting plate 300 may have a height and/or width of between approximately 1 inch and approximately 6 inches. The attachment plate 300 may have a triangular shape in some embodiments. FIG. 4B shows another embodiment of an attachment plate 400 having a pair of pins 402 arranged thereon for coupling to one or more frame poles. As shown in FIG. 4B, the attachment plate 400 may have a square shape, which may include rounded corners, for example. In other embodiments, an attachment plate may have a round, rectangular, or other suitable shape. It is understood, however, that any shape and size of a mounting or attachment plate and frame poles is contemplated by the present disclosure.

Figure 5:
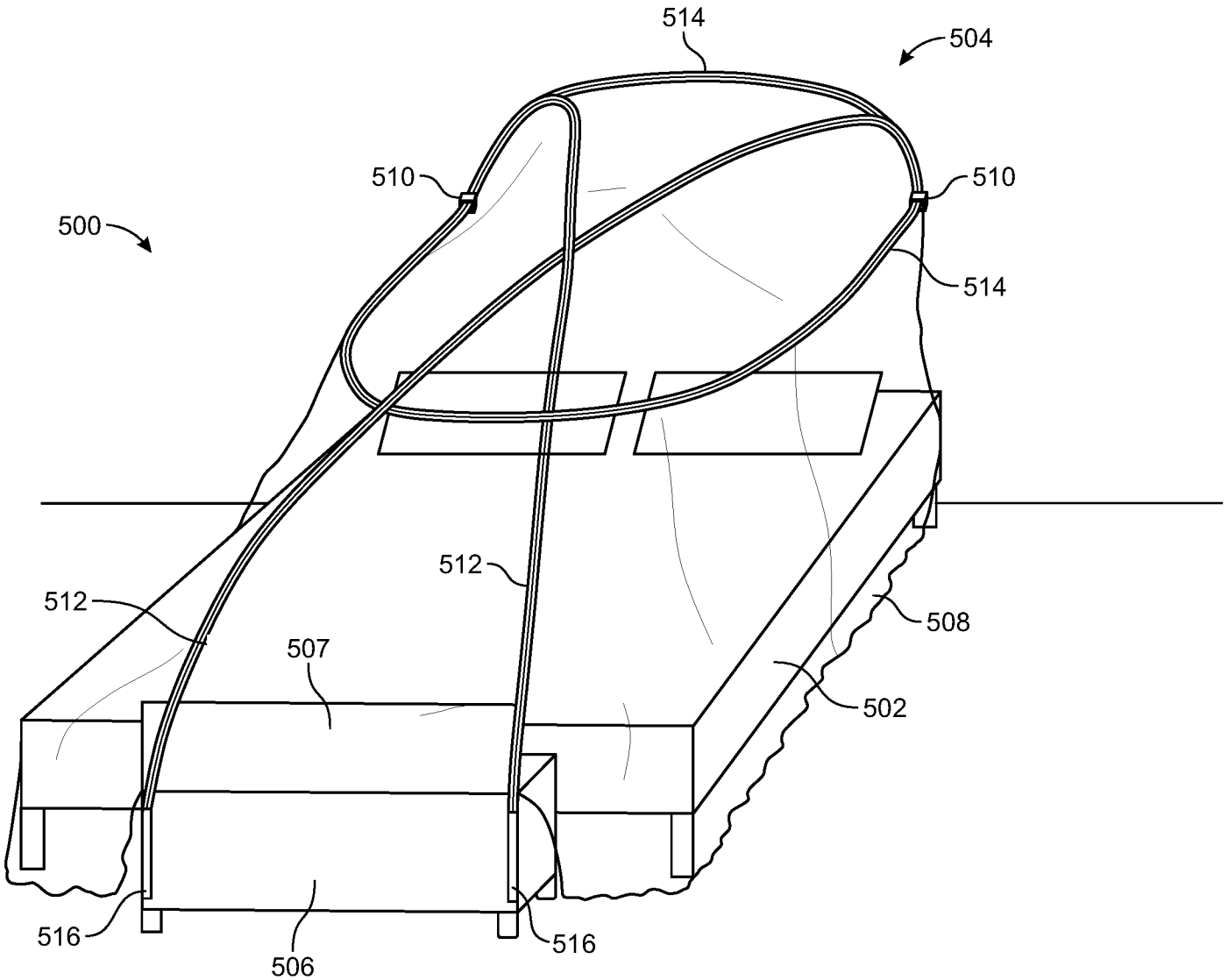
FIG. 5 is a perspective view of an embodiment of a sleep enclosure assembly of the present disclosure in a fully deployed position.
Figure 6:
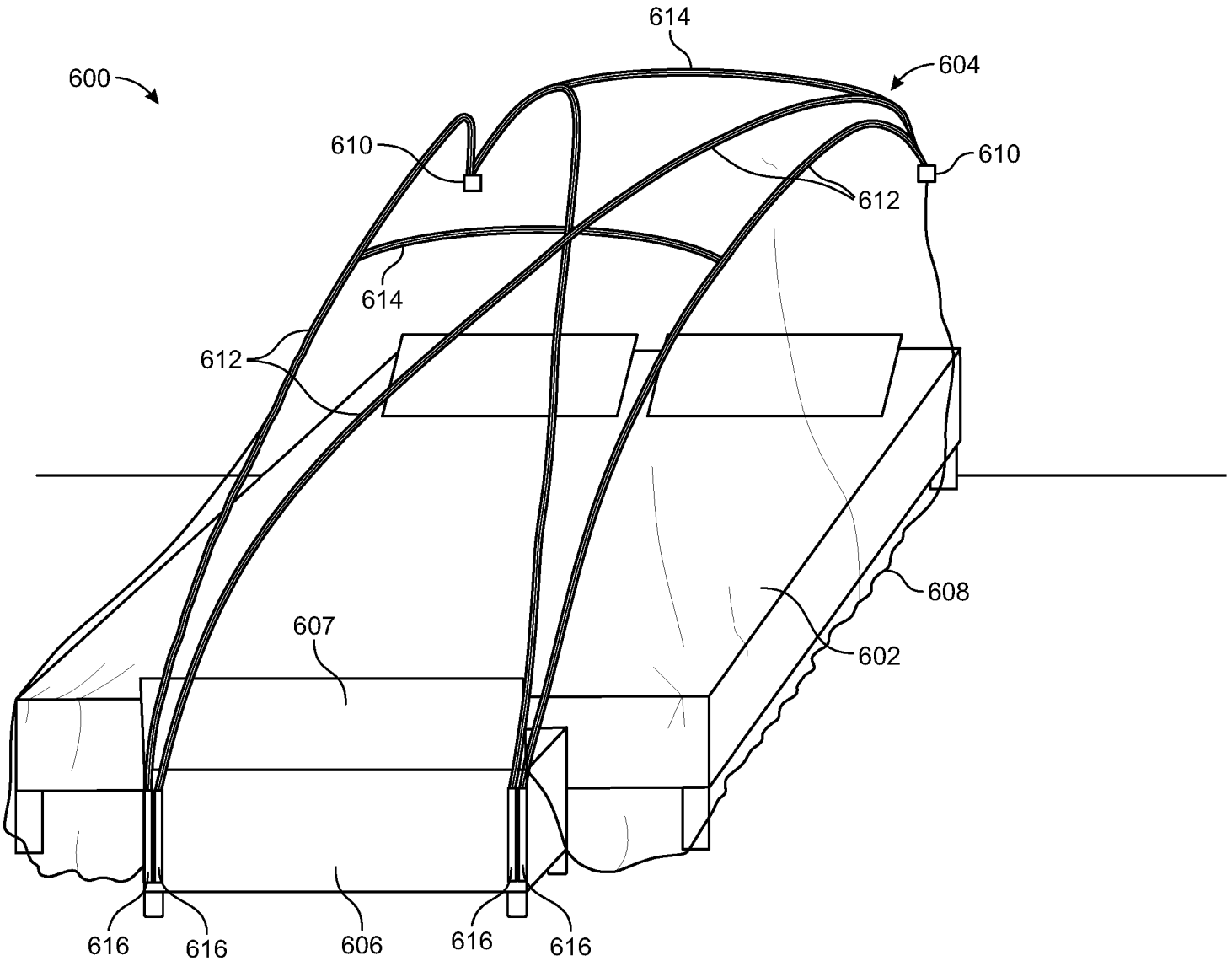
FIG. 6 is a perspective view of an embodiment of a sleep enclosure assembly of the present disclosure in a fully deployed position.

FIGS. 5 and 6 show additional embodiments of enclosure assemblies of the present disclosure. For example, FIG. 5 shows an enclosure 500 arranged over a bed 502. The enclosure 500 may include a frame 504 extending from a housing 506, and a canopy 508 suspended from the frame. The canopy 508 may include a canopy material, similar to some of those discussed above, and may be configured to drape around the bed 502 to form an enclosure. The canopy 508 may have sleeves, loops, clips, or any suitable mechanism for coupling to the frame 504. The frame 504 may include a plurality of poles, which may include longitudinal poles 512 and lateral poles 514. As a particular example, two longitudinal poles 512 may be configured to extend between the housing 502 and a wall, headboard, or other surface adjacent the bed 502. For example, each pole 512 may extend with an arced shape between the housing 506 and an attachment plate 510. The frame 504 may additionally include one or more lateral poles 514 configured to extend between two attachment plates 510. For example, as shown in FIG. 5, a lateral pole 514 may have a U-shape or semi-circular shape and may extend from a first connection at a first attachment plate 510 outward across the bed or upward above the bed to a second connection at a second attachment plate. Where poles 512, 514 intersect with one another, they may couple together via a clip, pin, or other suitable coupling mechanism. However, in other embodiments, one pole may rest above an intersecting pole.

As described above, the poles 512, 514 may be configured to extend automatically from the housing 506. In other embodiments, one or more poles 512, 514 may be configured to be manually extended and/or positioned by a user. In some embodiments, each pole 510, 512 may be collapsible. For example, each pole may have a plurality of connectable sections that may couple together using threading, clamps, clips, tongue and groove, ball and plunger, and/or other suitable coupling mechanisms. In some embodiments, a line or cable may extend relatively loosely through the plurality of sections of a pole so as to maintain an order or alignment of the pole sections, while allowing them to be disconnected from one another for collapsing the pole. In other embodiments, a pole may have a plurality of telescoping sections or may be collapsible in other ways. Each longitudinal pole 512 may have a length of between approximately 5 feet and approximately 30 feet, or between approximately 10 feet and approximately 20 feet. Each lateral pole 514 may have a length shorter than the longitudinal poles 512. For example, each lateral pole 514 may have a length of between approximately 2 feet and approximately 15 feet, or between approximately 4 feet and approximately 10 feet. In still other embodiments, longitudinal 512 and lateral 514 poles may have other suitable dimensions. Collapsible or telescoping poles may be configured to collapse into sections each having a length of between approximately 6 inches and approximately 24 inches.

The housing 506 may be sized and shaped to receive the frame 504 and canopy 508 when they are not in use. In some embodiments, the housing 506 may have a generally rectangular shape with an upper door 507 configured to open so as to allow the frame 504 to extend from the housing, whether automatically or manually performed by a user. In some embodiments, the housing 506 may have one or more holsters 516 from which one or more poles 512 may extend. The housing 506 may be arranged at or near a foot of the bed 502 in some embodiments.

FIG. 6 shows another embodiment of an enclosure assembly 600 of the present disclosure. As shown, the enclosure assembly 600 may be arranged over a bed 602 and may include a frame 604 extending from a housing 606, and a canopy 608 suspended from the frame. The canopy 608 may be similar to some of those discussed above. The frame 604 may include one or more longitudinal poles 612 extending with an arced shape between the housing 606 and one or more attachment plates 610 arranged on a wall or headboard over the bed 602. For example, the frame 604 may include four longitudinal poles 612 each extending from a holster 616 of the housing 606 to an attachment plate 610. The frame 604 may additionally include one or more lateral poles 614 extending between two longitudinal poles 612. For example, a lateral pole 614 may couple at a first end to a point along the length of a longitudinal pole 612, and may extend with an arced shape to a point along the length of a second longitudinal pole. In some embodiments, the frame 604 may have two lateral poles 614. In still other embodiments, the frame 604 may include any other suitable number of lateral 614, longitudinal 612, or other poles, each of which may be arranged in any suitable configuration so as to position the canopy 608 over the bed 602 to define an enclosure.

While some embodiments discussed above disclose a canopy frame design utilizing two or more canopy poles for supporting the canopy material, a variety of other canopy frame designs may be used according the present disclosure. It is therefore understood that the disclosed sleep enclosure may be configured in a variety of ways such that the sleep area is fully or partially enclosed by the canopy of the sleep enclosure assembly. For example, rather than rigid canopy poles, a canopy may be supported by one or more cables or lines stretching from one side of the sleeping area to the opposite side. In other embodiments, a curtained configuration may be used, such that the canopy material is retracted or folded into a housing stored above or below the bed, and secured to the opposite side of the sleep area using fastening mechanisms, such as ties, buttons, hooks, or latches. Similarly, in other embodiments, rather than stretching between a footboard and headboard area of a bed or sleep area, other embodiments of the present invention may stretch from a lateral side of the bed or sleep area to the opposite side. In an alternative embodiment, the canopy frame may not be retractable, and may be a permanent feature of the bed or sleep area. The sleep enclosure assembly of the present disclosure may be employed with any size and shape of bed, bedframe, mattress, or sleep area, including but not limited to California King sized bed and smaller.

As discussed above, in some embodiments of the sleep enclosure assembly of the present disclosure, software applications running on one or more computing devices may be used to control any module of the sleep enclosure assembly, including environmental modules as well as mechanical movement of the canopy itself. The disclosed software applications may be preprogrammed, or customized by a user in order to specify any preferred customization or combination of any controllable features or elements. The disclosed software applications may further allow for integration with one or more smart home networks or devices, including but not limited to Amazon Echo or Google Home enabled devices. In some embodiments, the sleep enclosure assembly may include a microphone in order to receive voice control commands for a user, which may allow a user to access or command any module or feature of the sleep enclosure assembly.

In some embodiments, the software applications may include features designed to retain and apply the preferences of one or more users, thereby allowing each user to access his or her own preferred sleep preferences. In certain embodiments, a divider may divide the sleep area between users such that each user's sleep environment may be personalized according to his or her preferences. A divider as contemplated by the present disclosure may comprise one or more fabrics, plastics, or other suitable materials. The divider may further insulate an individual user's sleep area from the sounds and/or climate of an adjacent user's sleep area.

For purposes of this disclosure, any system described herein may include any instrumentality or aggregate of instrumentalities operable to compute, calculate, determine, classify, process, transmit, receive, retrieve, originate, switch, store, display, communicate, manifest, detect, record, reproduce, handle, or utilize any form of information, intelligence, or data for business, scientific, control, or other purposes. For example, a system or any portion thereof may be a minicomputer, mainframe computer, personal computer (e.g., desktop or laptop), tablet computer, mobile device (e.g., personal digital assistant (PDA) or smart phone) or other hand-held computing device, server (e.g., blade server or rack server), a network storage device, or any other suitable device or combination of devices and may vary in size, shape, performance, functionality, and price. A system may include volatile memory (e.g., random access memory (RAM)), one or more processing resources such as a central processing unit (CPU) or hardware or software control logic, ROM, and/or other types of nonvolatile memory (e.g., EPROM, EEPROM, etc.). A basic input/output system (BIOS) can be stored in the non-volatile memory (e.g., ROM), and may include basic routines facilitating communication of data and signals between components within the system. The volatile memory may additionally include a high-speed RAM, such as static RAM for caching data.

Additional components of a system may include one or more disk drives or one or more mass storage devices, one or more network ports for communicating with external devices as well as various input and output (I/O) devices, such as a keyboard, a mouse, touchscreen and/or a video display. Mass storage devices may include, but are not limited to, a hard disk drive, floppy disk drive, CD-ROM drive, smart drive, flash drive, or other types of non-volatile data storage, a plurality of storage devices, a storage subsystem, or any combination of storage devices. A storage interface may be provided for interfacing with mass storage devices, for example, a storage subsystem. The storage interface may include any suitable interface technology, such as EIDE, ATA, SATA, and IEEE 1394. A system may include what is referred to as a user interface for interacting with the system, which may generally include a display, mouse or other cursor control device, keyboard, button, touchpad, touch screen, stylus, remote control (such as an infrared remote control), microphone, camera, video recorder, gesture systems (e.g., eye movement, head movement, etc.), speaker, LED, light, joystick, game pad, switch, buzzer, bell, and/or other user input/output device for communicating with one or more users or for entering information into the system. These and other devices for interacting with the system may be connected to the system through I/O device interface(s) via a system bus, but can be connected by other interfaces such as a parallel port, IEEE 1394 serial port, a game port, a USB port, an IR interface, etc. Output devices may include any type of device for presenting information to a user, including but not limited to, a computer monitor, flat-screen display, or other visual display, a printer, and/or speakers or any other device for providing information in audio form, such as a telephone, a plurality of output devices, or any combination of output devices.

A system may also include one or more buses operable to transmit communications between the various hardware components. A system bus may be any of several types of bus structure that can further interconnect, for example, to a memory bus (with or without a memory controller) and/or a peripheral bus (e.g., PCI, PCIe, AGP, LPC, etc.) using any of a variety of commercially available bus architectures.

One or more programs or applications, such as a web browser and/or other executable applications, may be stored in one or more of the system data storage devices. Generally, programs may include routines, methods, data structures, other software components, etc., that perform particular tasks or implement particular abstract data types. Programs or applications may be loaded in part or in whole into a main memory or processor during execution by the processor. One or more processors may execute applications or programs to run systems or methods of the present disclosure, or portions thereof, stored as executable programs or program code in the memory, or received from the Internet or other network. Any commercial or freeware web browser or other application capable of retrieving content from a network and displaying pages or screens may be used. In some embodiments, a customized application may be used to access, display, and update information. A user may interact with the system, programs, and data stored thereon or accessible thereto using any one or more of the input and output devices described above.

A system of the present disclosure can operate in a networked environment using logical connections via a wired and/or wireless communications subsystem to one or more networks and/or other computers. Other computers can include, but are not limited to, workstations, servers, routers, personal computers, microprocessor-based entertainment appliances, peer devices, or other common network nodes, and may generally include many or all of the elements described above. Logical connections may include wired and/or wireless connectivity to a local area network (LAN), a wide area network (WAN), hotspot, a global communications network, such as the Internet, and so on. The system may be operable to communicate with wired and/or wireless devices or other processing entities using, for example, radio technologies, such as the IEEE 802.xx family of standards, and includes at least Wi-Fi (wireless fidelity), WiMax, and Bluetooth wireless technologies. Communications can be made via a predefined structure as with a conventional network or via an ad hoc communication between at least two devices.

Hardware and software components of the present disclosure, as discussed herein, may be integral portions of a single computer or server or may be connected parts of a computer network. The hardware and software components may be located within a single location or, in other embodiments, portions of the hardware and software components may be divided among a plurality of locations and connected directly or through a global computer information network, such as the Internet. Accordingly, aspects of the various embodiments of the present disclosure can be practiced in distributed computing environments where certain tasks are performed by remote processing devices that are linked through a communications network. In such a distributed computing environment, program modules may be located in local and/or remote storage and/or memory systems.

As will be appreciated by one of skill in the art, the various embodiments of the present disclosure may be embodied as a method (including, for example, a computer-implemented process, a business process, and/or any other process), apparatus (including, for example, a system, machine, device, computer program product, and/or the like), or a combination of the foregoing. Accordingly, embodiments of the present disclosure may take the form of an entirely hardware embodiment, an entirely software embodiment (including firmware, middleware, microcode, hardware description languages, etc.), or an embodiment combining software and hardware aspects. Furthermore, embodiments of the present disclosure may take the form of a computer program product on a computer-readable medium or computer-readable storage medium, having computer-executable program code embodied in the medium, that define processes or methods described herein. A processor or processors may perform the necessary tasks defined by the computer-executable program code. Computer-executable program code for carrying out operations of embodiments of the present disclosure may be written in an object oriented, scripted or unscripted programming language such as Java, Perl, PHP, Visual Basic, Smalltalk, C++, or the like. However, the computer program code for carrying out operations of embodiments of the present disclosure may also be written in conventional procedural programming languages, such as the C programming language or similar programming languages. A code segment may represent a procedure, a function, a subprogram, a program, a routine, a subroutine, a module, an object, a software package, a class, or any combination of instructions, data structures, or program statements. A code segment may be coupled to another code segment or a hardware circuit by passing and/or receiving information, data, arguments, parameters, or memory contents. Information, arguments, parameters, data, etc. may be passed, forwarded, or transmitted via any suitable means including memory sharing, message passing, token passing, network transmission, etc.

In the context of this document, a computer readable medium may be any medium that can contain, store, communicate, or transport the program for use by or in connection with the systems disclosed herein. The computer-executable program code may be transmitted using any appropriate medium, including but not limited to the Internet, optical fiber cable, radio frequency (RF) signals or other wireless signals, or other mediums. The computer readable medium may be, for example but is not limited to, an electronic, magnetic, optical, electromagnetic, infrared, or semiconductor system, apparatus, or device. More specific examples of suitable computer readable medium include, but are not limited to, an electrical connection having one or more wires or a tangible storage medium such as a portable computer diskette, a hard disk, a random access memory (RAM), a read-only memory (ROM), an erasable programmable read-only memory (EPROM or Flash memory), a compact disc read-only memory (CD-ROM), or other optical or magnetic storage device. Computer-readable media includes, but is not to be confused with, computer-readable storage medium, which is intended to cover all physical, non-transitory, or similar embodiments of computer-readable media.

As used herein, the terms "substantially" or "generally" refer to the complete or nearly complete extent or degree of an action, characteristic, property, state, structure, item, or result. For example, an object that is "substantially" or "generally" enclosed would mean that the object is either completely enclosed or nearly completely enclosed. The exact allowable degree of deviation from absolute completeness may in some cases depend on the specific context. However, generally speaking, the nearness of completion will be so as to have generally the same overall result as if absolute and total completion were obtained. The use of "substantially" or "generally" is equally applicable when used in a negative connotation to refer to the complete or near complete lack of an action, characteristic, property, state, structure, item, or result. For example, an element, combination, embodiment, or composition that is "substantially free of" or "generally free of" an element may still actually contain such element as long as there is generally no significant effect thereof.

In the foregoing description various embodiments of the present disclosure have been presented for the purpose of illustration and description. They are not intended to be exhaustive or to limit the invention to the precise form disclosed. Obvious modifications or variations are possible in light of the above teachings. The various embodiments were chosen and described to provide the best illustration of the principals of the disclosure and their practical application, and to enable one of ordinary skill in the art to utilize the various embodiments with various modifications as are suited to the particular use contemplated. All such modifications and variations are within the scope of the present disclosure as determined by the appended claims when interpreted in accordance with the breadth they are fairly, legally, and equitably entitled.

What is claimed is:

1. A sleep enclosure system for providing a controlled sleeping experience, the sleep enclosure system being configured for use with a bed, the system comprising:

an extendable canopy frame comprising a plurality of poles configured for arranging in a deployed position and a retracted position;

a canopy configured for suspending from the canopy frame to partially or fully enclose a sleep area, wherein the extendable canopy frame is coupled to the canopy such that tension is created across the canopy between the poles when the canopy frame is in the deployed position;

a housing configured to contain the canopy frame and canopy in the retracted position, wherein the housing is arranged proximate the bed;

wherein at least one pole of the canopy frame is configured to extend between the housing and a wall surface in the deployed position; and at least one attachment plate arranged between the at least one pole and the wall surface, wherein the attachment plate is configured for receiving the at least one pole.

2. The system of claim 1, wherein each of the poles is collapsible.

3. The system of claim 1, wherein the housing comprises an opening, and wherein in a deployed position, the poles extend through the opening.

4. The system of claim 1, wherein the canopy frame comprises two, three, four, five, or six poles.

5. The system of claim 1, wherein the poles are arranged along a motorized track when in a retracted position.

6. The system of claim 1, further comprising an environmental control module.

7. The system of claim 6, wherein the environmental control module comprises at least one of: an audio control module, a light control module, and a climate control module.

8. The system of claim 7, further comprising a user interface through which a user can operate the environmental control module.

9. A sleep enclosure assembly for use with a bed, the sleep enclosure assembly comprising:

an extendable canopy frame comprising at least two longitudinal members configured to extend over a sleeping area and at least one lateral member configured to be arranged perpendicular to the longitudinal members, the longitudinal members being movable between a deployed position and a storage position;

a canopy configured for partially or fully enclosing a sleep area, wherein the canopy is coupled to the canopy frame such that tension is created across the canopy between the at least two longitudinal members when the longitudinal members are in the deployed position;

a housing configured to contain the canopy frame and canopy when the canopy frame and canopy are not in use, the housing being arranged proximate the bed; and at least one attachment plate arranged between the at least two longitudinal members and a wall surface, wherein the attachment plate is configured for receiving one of the at least two longitudinal members.

10. The sleep enclosure assembly of claim 9, wherein the canopy frame is retractable.

11. The sleep enclosure assembly of claim 9, wherein the canopy frame is collapsible.

12. The sleep enclosure assembly of claim 9, further comprising an environmental control module, wherein the environmental control module comprises at least one of: an audio control module, a light control module, and a climate control module.

13. A sleep enclosure assembly for use with a bed, the assembly comprising:

an extendable canopy frame comprising a plurality of poles configured for arranging in a deployed position and a retracted position;

a canopy coupled to; and the extendable canopy frame such that upon deployment of the extendable canopy frame, the canopy automatically assumes the deployed position and tension is created across the canopy between the poles; and an attachment plate configured for placement on a wall surface, wherein the attachment plate receives at least one of the plurality of poles when the poles are in the deployed position.

14. The sleep enclosure assembly of claim 13, wherein the means comprises a motorized track.

15. The sleep enclosure assembly of claim 14, wherein the motorized track is configured to deploy the extendable canopy frame automatically.

16. The sleep enclosure assembly of claim 13, wherein the means comprises manual operation.

17. The sleep enclosure assembly of claim 13, further comprising an environmental control module, wherein the environmental control module comprises at least one of: an audio control module, a light control module, and a climate control module.

* * * * *